US008234070B2

(12) United States Patent
McNelis et al.

(10) Patent No.: US 8,234,070 B2
(45) Date of Patent: Jul. 31, 2012

(54) APPARATUS, SYSTEM, METHOD, AND COMPUTER PROGRAM PRODUCT FOR DETECTING PROJECTILES

(75) Inventors: Niall B. McNelis, Sparks Glencoe, MD (US); Matthew Livelsberger, Hanover, PA (US)

(73) Assignee: AAI Corporation, Hunt Valley, MD (US)

( * ) Notice: Subject to any disclaimer, the term of this patent is extended or adjusted under 35 U.S.C. 154(b) by 408 days.

(21) Appl. No.: 12/487,542

(22) Filed: Jun. 18, 2009

(65) Prior Publication Data

US 2010/0320691 A1 Dec. 23, 2010

(51) Int. Cl.

| | |
|---|---|
| ***G01B 17/00*** | (2006.01) |
| ***G01H 17/00*** | (2006.01) |
| ***G01P 13/00*** | (2006.01) |
| ***G06F 19/00*** | (2006.01) |
| ***G06F 17/40*** | (2006.01) |

(52) U.S. Cl. ..... 702/1; 73/167; 235/400; 702/127; 702/158; 708/105; 708/200

(58) Field of Classification Search ..... 73/167; 181/125; 235/400; 367/118; 702/1, 33, 702/127, 150, 155, 158, 187, 189; 708/100, 708/105, 131, 160, 200

See application file for complete search history.

(56) References Cited

U.S. PATENT DOCUMENTS

| | | | | |
|---|---|---|---|---|
| 3,295,128 | A * | 12/1966 | Canaday et al. | 342/129 |
| 5,988,645 | A | 11/1999 | Downing | |
| 6,109,614 | A | 8/2000 | Ciarcia | |
| 6,415,211 | B1 | 7/2002 | Kotlow | |
| 6,549,872 | B2 | 4/2003 | Bollweg et al. | |
| 6,669,477 | B2 | 12/2003 | Hulet | |
| 2003/0008265 | A1 * | 1/2003 | Hulet | 434/14 |
| 2003/0082502 | A1 | 5/2003 | Stender et al. | |
| 2003/0136900 | A1 | 7/2003 | Shechter et al. | |
| 2004/0200109 | A1 | 10/2004 | Vasquez | |
| 2005/0116421 | A1 | 6/2005 | Kuosa | |
| 2006/0050610 | A1 | 3/2006 | Harvey et al. | |
| 2007/0035528 | A1 | 2/2007 | Hodge | |
| 2007/0067138 | A1 | 3/2007 | Rabin et al. | |
| 2008/0020354 | A1 | 1/2008 | Goree et al. | |
| 2008/0167835 | A1 | 7/2008 | Zank et al. | |
| 2008/0289485 | A1 | 11/2008 | Quinn et al. | |
| 2010/0324859 | A1 * | 12/2010 | McNelis et al. | 702/150 |
| 2010/0324863 | A1 * | 12/2010 | McNelis | 702/151 |

OTHER PUBLICATIONS

International Search Report and Written Opinion issue in PCT/US2010/39044, dated Mar. 11, 2011.

International Search Report and Written Opinion issued in PCT/US10/39052, dated Mar. 11, 2011.

International Search Report and Written Opinion Issued in PCT/US2010/39049, dated Mar. 4, 2011.

* cited by examiner

*Primary Examiner* — Edward Cosimano

(74) *Attorney, Agent, or Firm* — Venable LLP; Jeffri A. Kaminski

(57) ABSTRACT

An exemplary embodiment of the present invention sets forth an apparatus for registering a scoring event. The apparatus includes a target having a surface; a sensor, positioned in proximity to the target, adapted to detect the occurrence of a scoring event caused by the presence of a projectile in the scoring area and to determine a trajectory of the projectile; a time tracking device adapted to keep track of time of the scoring event; a location sensing device adapted to identify a location of the apparatus; a true north detection device adapted to detect the direction of true north with respect to the surface of the target; and a controller, coupled to the sensor and the true north detection device.

10 Claims, 10 Drawing Sheets

APPARATUS, SYSTEM, METHOD, AND COMPUTER PROGRAM PRODUCT FOR DETECTING PROJECTILES

CROSS-REFERENCE TO RELATED APPLICATIONS

The present application is related to co-pending U.S. patent application Ser. No. 12/487,545 entitled "Method and System For Correlating Weapon Firing Events With Scoring Events,", and co-pending U.S. patent application Ser. No. 12/487,539 entitled "Apparatus, System, Method, and Computer Program Product for Registering the Time and Location of Weapon Firings,", the contents of which are incorporated herein by reference in their entirety.

BACKGROUND

When new military weapons are evaluated, it may be advantageous to evaluate the weapons under actual combat conditions. Thus soldiers and marines may be run through actual platoon attack scenarios with live fire. However, to determine the effectiveness of the weapon, or the skill of the user of the weapon, each bullet fired must be correlated with the impact point of that bullet. This requires that each bullet fired be linked to the weapon that fired it, and that the time and location of the firing be known. Marking bullets, for example, through coloration, may allow bullets to be linked back to the respective weapons of the bullets, but provides no information as to where and when the bullet was fired. Bullets may also be lost, especially if the bullets miss the bullets' target, or if the bullets are destroyed, if the bullets hit a target.

SUMMARY

An exemplary embodiment of the present invention sets forth an apparatus for registering a scoring event. The apparatus includes a scoring area; a sensor, positioned in proximity to said scoring area, adapted to detect the occurrence of a scoring event caused by the presence of a projectile in said scoring area and to determine a trajectory of the projectile; a time tracking device adapted to keep track of time; a location detection device adapted to identify a location of the apparatus; a reference detection device adapted to identify a reference direction; and a controller, coupled to said sensor, said time tracking device, said location detection device, and said reference direction detection device, adapted to determine, based on said trajectory of the projectile and said reference direction, an angle of incidence, with respect to said reference direction, of the projectile upon impact with said scoring area and to record, in a memory, an occurrence of said scoring event, said angle of incidence, the time of said scoring event, and said location of the apparatus when said scoring event occurred.

According to one exemplary embodiment, the sensor is adapted to transmit the occurrence of the scoring event caused by a projectile and the trajectory of the projectile to the controller; the time tracking device transmits the time to the controller; the location detection device transmits the location to the controller; and the reference direction detection device transmits the reference direction to the controller.

According to one exemplary embodiment, the apparatus may further include a lifter coupled to the target and adapted to move the target between a scoring and non-scoring position.

According to one exemplary embodiment, the time tracking device, the location detection device, and the true north device are placed within a single housing.

According to one exemplary embodiment, the time tracking device, the location detection device, and the reference direction detection device comprise a global positioning system (GPS) receiver.

According to one exemplary embodiment, the location detection device comprises a global positioning system (GPS) receiver and the time tracking device comprises an internal clock synchronized by the GPS receiver.

According to one exemplary embodiment, the apparatus may further include a velocity sensing device adapted to record a velocity of the projectile upon impact with the target.

An exemplary embodiment of the present invention sets forth a method for registering a scoring event. The method includes determining that a scoring event, caused by a projectile, has occurred in the vicinity of a target; determining a position of said target when said scoring event occurred; determining a time at which said scoring event occurred; determining an orientation of the scoring area, with respect to a reference direction when said scoring event occurred; determining an angle of incidence of the projectile when the scoring event occurred based on said orientation of said scoring area; and recording said time at which said scoring event occurred and said angle of incidence of the projectile in a memory.

An exemplary embodiment, the method may further include determining a velocity of the projectile.

Further features of the exemplary embodiments, as well as the structure and operation of various exemplary embodiments, are described in detail below with reference to the accompanying drawings.

BRIEF DESCRIPTION OF THE DRAWINGS

The foregoing and other features and advantages of the invention will be apparent from the following, more particular description of various exemplary embodiments, as illustrated in the accompanying drawings wherein like reference numbers generally indicate identical, functionally similar, and/or structurally similar elements. The left most digits in the corresponding reference number indicate the drawing in which an element first appears.

DETAILED DESCRIPTION OF VARIOUS EXEMPLARY EMBODIMENTS

Various exemplary embodiments are discussed in detail below. While specific exemplary embodiments are discussed, it should be understood that this is done for illustration purposes only. In describing and illustrating the exemplary embodiments, specific terminology is employed for the sake of clarity. However, the embodiments are not intended to be limited to the specific terminology so selected. A person skilled in the relevant art will recognize that other components and configurations may be used without parting from the spirit and scope of the embodiments. It is to be understood that each specific element includes all technical equivalents that operate in a substantially similar manner to accomplish a similar purpose. The examples and embodiments described herein are non-limiting examples.

Figure 1:
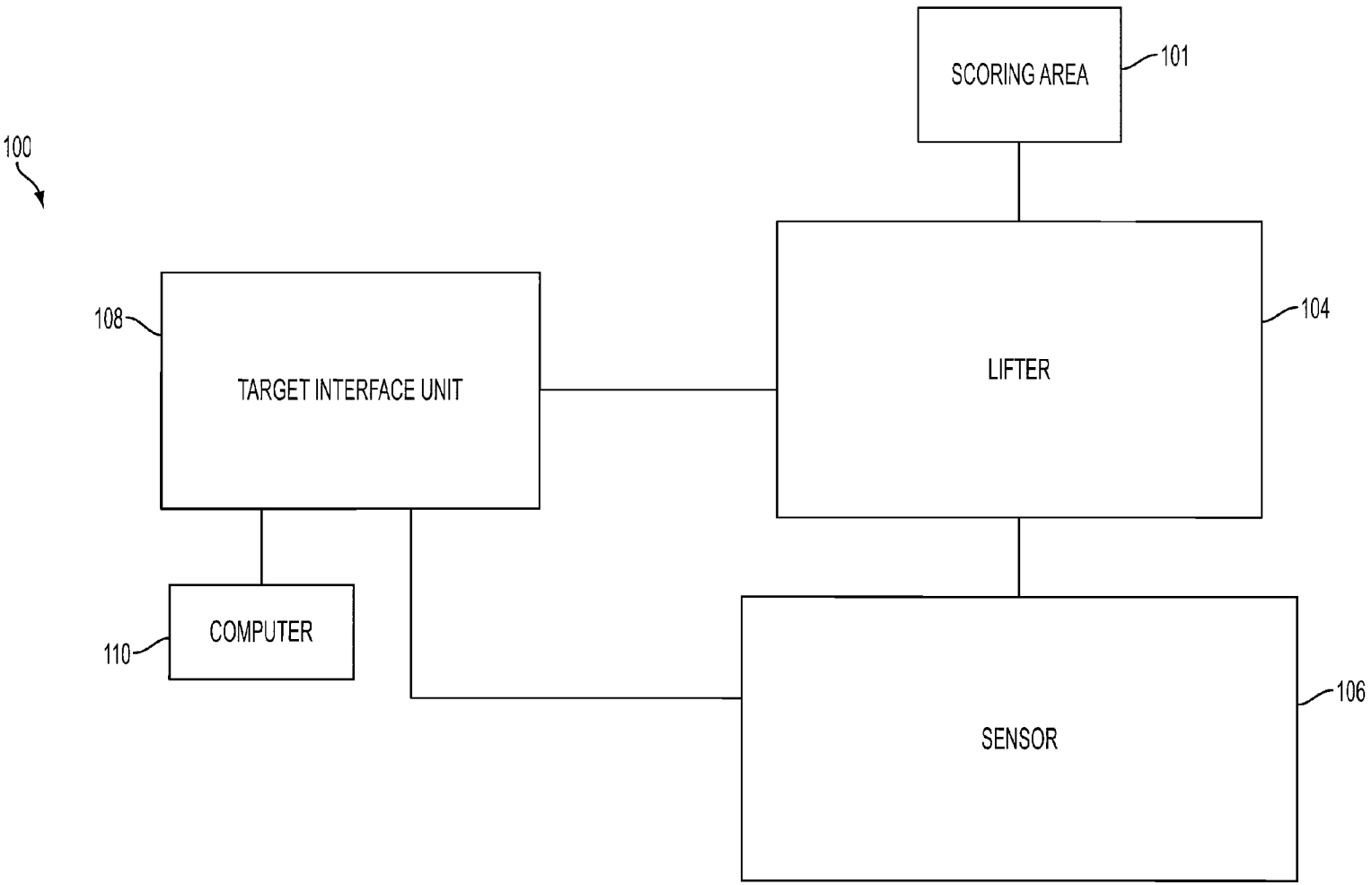
FIG. 1 depicts a block diagram for an exemplary target scoring apparatus (TSA).

FIG. 1 depicts a block diagram for an exemplary target scoring apparatus (TSA) 100. The exemplary TSA 100 may include, for example, but is not limited to, a scoring area 101, a lifter 104, a sensor 106, a target interface unit (TIU) 108, and a computer 110. While the scoring area 101, lifter 104, sensor 106, (TIU) 108, and computer 110 are described separately below, they may be combined into one or more combined devices according to an exemplary embodiment. Furthermore, in an exemplary embodiment, the components of the TSA 100 may include hardware, firmware, software, or any combination of hardware, firmware and software.

In an exemplary embodiment of the TSA 100, the scoring area 101 may include, for example, but not limited to, a target 102 and suppression zone 103. According to an exemplary embodiment, the scoring area 101 may include at least two dimensions. An exemplary target 102 and an exemplary suppression zone 103 are described further below with reference to FIGS. 3A, 3B, 9A, and 9B. In an exemplary embodiment, the scoring area 101 may be coupled to lifter 104.

The target 102 may be, for example, an object within the scoring area 101 at which a projectile may be fired. The target 102 may include one or more hit areas and/or miss areas. In an exemplary embodiment, the target 102 may be a two dimensional target (such as, e.g., but not limited to a circular target or a silhouette target), and/or a three dimensional target (such as, e.g., but not limited to a replica of a person or animal). The scoring area 101 may also include more than one target 102.

In an exemplary embodiment, the suppression zone 103 may refer to a zone surrounding the target 102 when the target 102 is in an exposed position and/or an area adjacent to the target 102 when the target 102 is in an unexposed position. The suppression zone 103 may represent an area in which projectiles may be intended to suppress the target 102, and may not necessarily be intended to impact the target 102.

In an exemplary embodiment of the TSA 100, the lifter 104 may be coupled electrically, wired, wirelessly, physically and/or mechanically, including via a communications link (directly, or indirectly) to the scoring area 101, the target 102, the sensor 106, the TIU 108, and/or the computer 110. The lifter 104 may be coupled to a target 102 in order to position the scoring target 102 in an exposed position (in which, for example, the target 102 may be exposed to incoming projectiles) (not shown) and/or move the target 102 between an exposed position and a non-exposed position (in which, for example, incoming projectiles are unable to impact the surface of the target 102) (not shown). The lifter 104 may move the target 102 between an exposed and an unexposed position by, for example, but not limited to, moving the target 102 to/from a raised position, by moving the target 102 vertically, moving the target 102 horizontally, and/or rotating the target 102.

In an exemplary embodiment, the lifter 104 may be combined with one or more of the scoring area 101, target 102, the sensor 106, the TIU 108, and/or the computer 110.

In an exemplary embodiment of the TSA 100, one or more sensors 106 may be electrically, wirelessly, mechanically and/or physically (directly or indirectly) coupled to the scoring area 101, the target 102, lifter 104, the TIU 108, and/or the computer 110. The sensor 106 may also be electrically, wirelessly, mechanically, and/or physically coupled to the TIU 108, and/or the computer 110 and located within a proximity to the scoring area 101, the target 102, and/or the lifter 104. For example, the sensor 106 may be located within several inches to several feet from the scoring area 101, the target 102, and lifter 104. In an exemplary embodiment, the sensor 106 may be located within a proximity to the scoring area 101, the target 102, and/or the lifter 104 but may not necessarily be electrically, wirelessly, mechanically, and/or physically coupled to the TIU 108, and/or the computer 110. For example, the sensor 106 may be located within several inches to several feet from the scoring area 101, the target 102, and lifter 104.

An exemplary sensor 106 which may be physically coupled to the scoring area 101, the target 102 and/or the lifter 104 may include a contact sensor. A contact sensor may detect scoring events by sensing vibrations of the target 102 and suppression zone 103 caused by the impact of projectiles.

An exemplary sensor 106 which may be located within a proximity to the scoring area 101, the target 102 and/or the lifter 104 may include a non-contact hit sensor. A non-contact hit sensor may detect the presence of projectiles in the scoring area 101 by, for example, recording and interpreting acoustical information. The non-contact hit sensor may also be electrically, wirelessly, and/or physically coupled two the scoring area 101, the target 102 and/or the lifter 104

In an exemplary embodiment, the sensor 106 may communicate with (via, e.g., but not limited, a wired and/or wireless communication link) and/or monitor the lifter 104 and/or the target 102, for a scoring event alone or in combination with the TIU 108 and/or computer 110. The sensor 106 may be able to detect a scoring event. A scoring event may occur when a projectile passes through the scoring area 101. The sensor 106 may also be able to detect the ambient temperature of the air in proximity to the sensor 106.

In an exemplary embodiment, once the sensor 106 has detected a scoring event, the sensor 106 may transmit data related to the scoring event to the TIU 108, which may store the data related to the event within the sensor 106, and/or may transmit the data related to the event to the computer 110. In an exemplary embodiment, the sensor 106 may be combined with one or more of the scoring area 101, target 102, lifter 104, the TIU 108, and/or the computer 110.

In an exemplary embodiment of the TSA 100, the TIU 108 may be electrically, via a wired link, wirelessly, mechanically and/or physically (directly or indirectly) coupled to the target 102, the lifter 104, the sensor 106, and/or the computer 110. In an exemplary embodiment, the TIU 108 may monitor and/or communicate with the sensor 106 for data related to scoring events. Once the sensor 106 has determined that a scoring event has occurred, the TIU 108 may request and/or receive data related to the scoring event from the sensor 106 and/or the lifter 104. The TIU 108 may then store the data related to the event internally and/or may transmit the data related to the event to the computer 110. In an exemplary embodiment, the TIU 108 may be combined with one or more of the scoring area 101, the target 102, lifter 104, the sensor 106, and/or the computer 110.

In an exemplary embodiment of the TSA 100, the computer 110 may be electrically or wirelessly coupled to the TIU 108 and/or sensor 106. The computer may be an external computing device capable of sending and/or receiving information with the target 102, the lifter 104, the sensor 106, and/or the TIU 108. An exemplary computer 110 is described further below with reference to FIG. 6.

Figure 2:
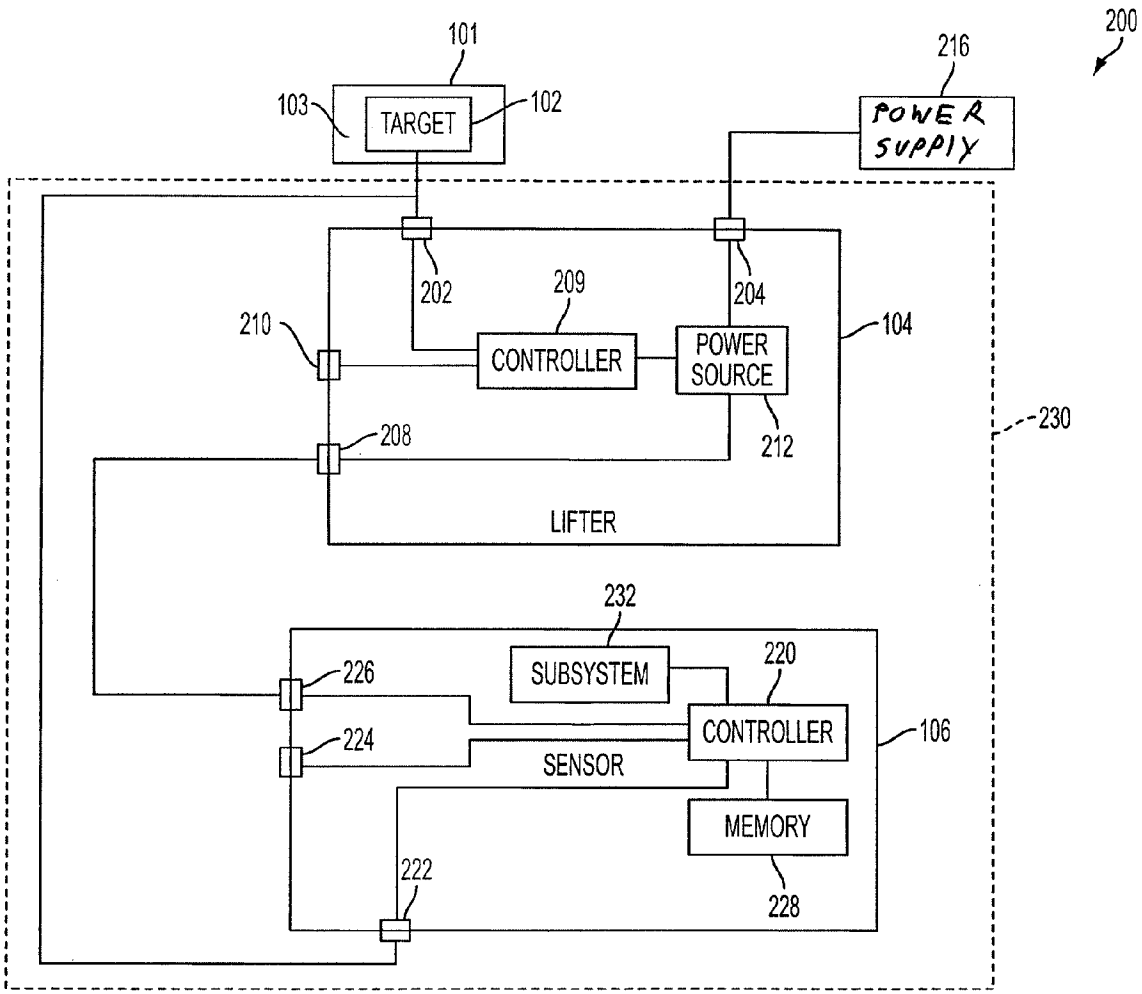
FIG. 2 depicts a block diagram for an exemplary scoring area, lifter, and sensor.

FIG. 2 depicts an exemplary detailed block 200 diagram for an exemplary scoring area 101, an exemplary lifter 104 and an exemplary sensor 106 for an exemplary TSA 100. Lifter 104 may, for example, include a target port 202, an input power supply port 204, an output power supply port 208, a data input/output port 210, and/or internal power source 212. Although an exemplary embodiment depicts an internal power source 212, as will be apparent to those skilled in the art, an external power supply 216 may also be used.

In an exemplary embodiment, the target port 202 of the lifter 104 may be connected, coupled, mechanically, physically, electrically (wired or wirelessly), and/or wirelessly, to the target 102. The lifter 104 may be electrically, wirelessly, and/or mechanically coupled to a target 102 in order to position the target 102 in an exposed position (in which, for example, the target 102 is exposed to incoming projectiles) and/or move the target 102 between an exposed position and a non-exposed position (in which, for example, incoming projectiles are unable to impact the surface of the target 102). The lifter 104 may move the target 102 between an exposed and an unexposed position by, for example, but not limited to, moving the target 102 to/from a raised position, moving the target 102 vertically, and/or moving the target 102 horizontally. Lifter 104 may include one or more electro-mechanical devices such as, e.g., but not limited to, a servo-motor, a lever, an electrical motor, etc. for lifting and/or lowering target 102. Lifter 104, in an exemplary embodiment, include a controller 209, which may include a processor and/or memory (not shown).

In an exemplary embodiment, the input power supply port 204 may be electrically coupled to the internal power source 212, and may enable the internal power source 212 to receive power from an external power supply 216. Power supply 216 may be any suitable power source for providing power to the lifter 104 and/or the TIU 108 and/or TSA 100 as a whole. In an exemplary embodiment, the power supply 216 may include, e.g., but is not limited to, a power source (such as, e.g., but not limited to a battery, a generator, a fuel cell, or a solar power array) and/or a power management system.

In an exemplary embodiment, the internal power source 212 may be a power source (such as, e.g., but not limited to, a battery, a generator, a fuel cell, and/or a solar power array) and/or a power management system.

In an exemplary embodiment, the internal power source 212 and/or the external power source 216 may include a battery, which may be a rechargeable battery, such as, e.g., but not limited to, a lithium-ion battery, nickel metal hydride, and/or nickel cadmium, etc. or a non-rechargeable battery, such as, e.g., but not limited to, lead acid, and/or zinc air, etc., and may be removable or non-removable. The battery may be designed specifically for the apparatus, or may be a more common battery cell type such as an AA battery. The power source 212 may be designed to accept multiple battery types. Power from the battery may be used to run some or all of the electronic elements of the apparatus.

In an exemplary embodiment, the internal power source 212 and/or the external power source 216 may include a power management system. The power management system may include any suitable electronic circuit for managing the use of power by the lifter 104, the sensor 106, and/or the TIU 108. For example, the power management unit may manage the power used from the battery, the recharging of the battery, and/or facilitating the power usage of the lifter 104. For example, the power management system may control the distribution of power to the lifter 104, the sensor 106 and/or the TIU 108 to ensure that the lifter 104, the sensor 106 and the TIU 108 do not unnecessarily drain the battery 262. The power management system may be disposed within, or may be external to, the lifter 104.

In an exemplary embodiment, the lifter 104 may be physically, mechanically and/or electrically (wired or wirelessly) coupled to the target 102 via target port 202 and/or input/output data port 210. The lifter 104 may be physically, mechanically, electrically, and/or wirelessly coupled to the sensor 106 via input/output data port 210. The lifter 104 may be physically, mechanically, electrically (wired or wirelessly), and/or wirelessly coupled to the TIU 108 via the input/output data port 210.

In an exemplary embodiment, the output power supply port 208 of the lifter 104 may be coupled to the power source 212 and may supply power to the sensor 106 via a power port 226, and/or the TIU 108. In an exemplary embodiment, the lifter 104 may include one or more output power supply ports 208 such that sensor 106 and the TIU 108 may be powered by the same or separate output power supply ports 208.

In an exemplary embodiment, the data input/output port 210 may, e.g., but not limited to, send/receive data to/from the sensor 106 and/or the TIU 108. In an exemplary embodiment, the lifter 104 may include one or more data input/output ports 210 such that the sensor 106 and the TIU 108 may send/receive data via the same or separate data input/output ports 210. In an exemplary embodiment, the one or more input/output power supply ports 208, 210, and 202 may be combined to form one or more combined ports.

In an exemplary embodiment, sensor 106 may, for example, include a controller 220, a target port 222, a data input/output port 224, an input power supply port 226 and/or a memory 228.

In an exemplary embodiment, controller 220 may be any suitable microprocessor, digital signal processor, etc. capable of processing the data received from the scoring area 101, the lifter 104, the TIU 108, and/or the computer 110.

In an exemplary embodiment, the sensor 106 may be physically, electrically, or wirelessly coupled to the scoring area 101 via target port 222 and/or input/output data port 224. The sensor 106 may be physically, electrically, or wirelessly coupled to the lifter 104 via the lifter port 224 and/or input/output data port 224. The sensor 106 may be physically, electrically, or wirelessly coupled to the TIU 108 via the input/output data port 224. The sensor 106 may also be located within a proximity to the scoring area 101 and/or the lifter 104. The sensor 106 and lifter 104 may also be enclosed with housing 230. The sensor 106, in an exemplary embodiment, may include a controller 220 and a sensor subsystem 232.

In an exemplary embodiment, the sensor 106 may receive power from the internal power source 212 and/or the external power source 216 via the input power supply port 226.

In an exemplary embodiment, the sensor 106 may sense and/or receive data from the scoring area 101 and/or the lifter 104 relating to scoring events which occurred within the scoring area 101. Data may refer to, e.g., but not limited to, electrical/wireless signals and/or vibrations from scoring area 101 as well as acoustical information from scoring area 101 or an area in proximity to the scoring area 101. The sensor 106 may then interpret the sensed and/or received data to record information related to the scoring events. An example of a scoring event which may occur in the scoring area 101 may be the presence of a projectile in an area of the target 102 (which may represent a hit), the presence of a projectile in a non-scoring area of the target 102 (which may represent a miss), and/or the presence of a bullet in the suppression zone 103 (which may represent a suppression shot).

In an exemplary embodiment the sensor 106 and/or controller 220 may use the gathered information to determine the trajectory of the projectile. The sensor 106 and/or controller 220 may then compare the trajectory of the projectile to several known characteristics of the scoring area 101 to determine whether the projectile caused an exemplary scoring event by striking the target 102 or the suppression zone 103.

Known characteristics of the scoring area 101 may refer to, for example, but not limited to, the size and/or shape of the target 102 and/or suppression zone 103, the distance of the scoring area 101 from the sensor 106, and/or the orientation of the scoring area 101 to the sensor 106. The known characteristics of the scoring area 101 may be supplied to sensor 106 by a user, the computer 110, the scoring area 101, and/or the TIU 108. The known characteristics may be stored in memory 228.

In an exemplary embodiment, the orientation of the scoring area 101 may refer to a direction the scoring area 101 faces. The direction the scoring area 101 faces may be dictated by the type of target 102 (for example, a traditional silhouette target may be oriented towards a single direction) or arbitrarily assigned (for example, a three dimensional target may be oriented in more than one direction).

In an exemplary embodiment, once the sensor 106 may detect a scoring event, the sensor 106 may determine information about the scoring event. The sensor 106 may, e.g., but not limited to, determine, for example, the trajectory of the projectile (i.e. the path of the projectile before, during, and after the projectile passes through the scoring area 101), one or more locations of the projectile while in the scoring area (e.g. accuracy), whether the projectile missed the target 102, and/or the velocity of the projectile upon impact with the target 102. In an exemplary embodiment, the trajectory of the projectile may be calculated by the TSA 100 in relation to a reference plane perpendicular to the direction of the orientation of the scoring area 101. In an exemplary embodiment, the reference plane may be defined by the position of the sensor 106 or may be independent of the position of sensor 106. In an exemplary embodiment, the reference plane may also be determined by a user survey. The user may then store the reference plane in memory 228, memory 228, and/or computer 110 for later reference.

Figure 3A:
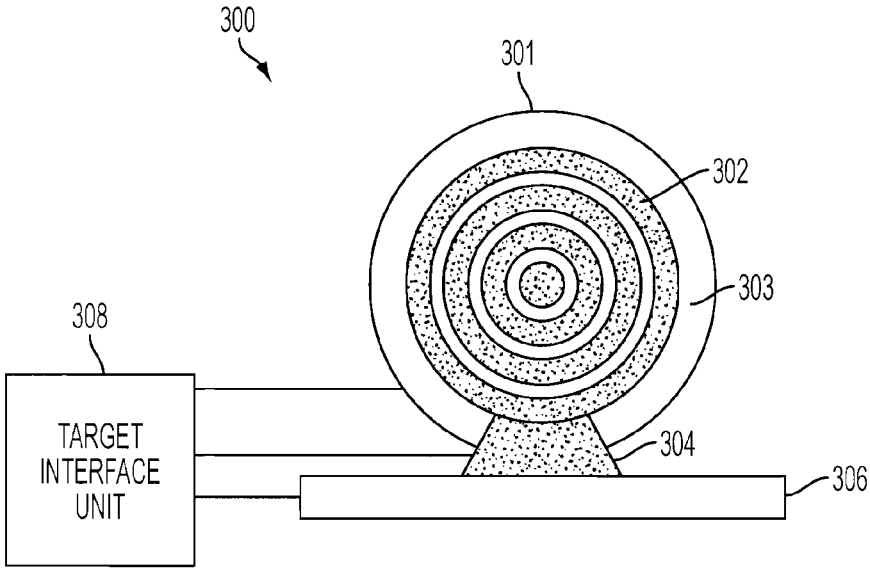
FIGS. 3A and 3B depict an exemplary front view and top view of an exemplary target scoring apparatus, respectively.
Figure 3B:
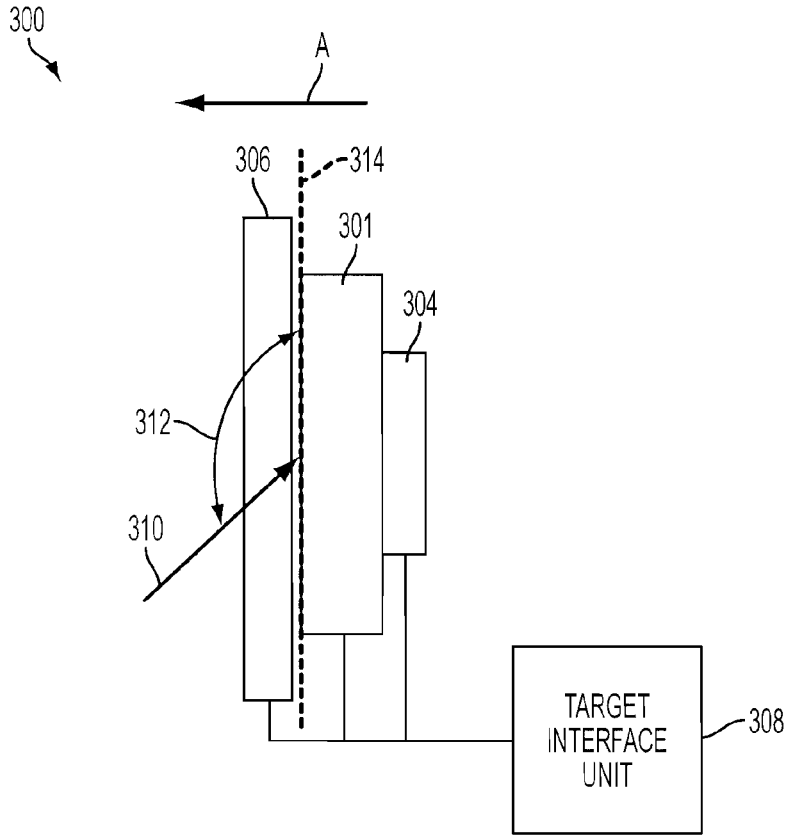

FIGS. 3A and 3B depicts an exemplary target scoring apparatus 300. FIG. 3A depicts the exemplary target scoring apparatus 300 including scoring area 301, target 302, suppression zone 303 coupled to an exemplary lifter 304, a sensor 306, and a TIU 308, when viewed from the front. In an exemplary embodiment, sensor 306 may be position in front of the scoring area 301.

FIG. 3B depicts the exemplary scoring area 301, the lifter 304, the sensor 306, a path 310 of the projectile as it passed through the scoring area 301, a reference plane 314, and an angle 312 created between the path 310 and the reference plane 314, when viewed from above. This angle may be referred to as an angle of incidence.

Figure 4:
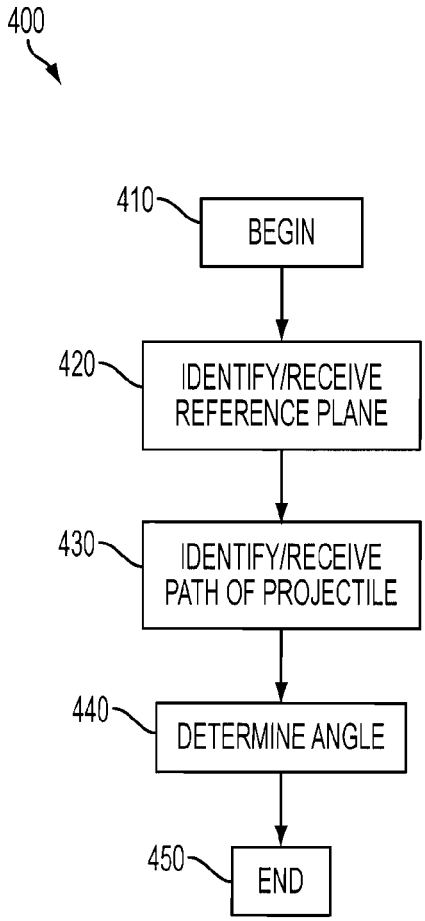
FIG. 4 depicts an exemplary flowchart for the operation of an exemplary TSA to determine the trajectory of a projectile which caused a scoring event.

FIG. 4 depicts an exemplary flowchart 400 for the operation of an exemplary TSA 300 to determine the trajectory of a projectile which caused a scoring event. Flowchart 400 is described with reference to FIGS. 3A and 3B. Flow diagram 400 may begin with block 410 and proceed directly to block 420.

In block 420, the TSA 300 may identify and/or receive the reference plane 314. In FIG. 3B, the reference plane 314 may be perpendicular to the orientation of the scoring area 301. The orientation of the scoring area 301 may refer to the direction the scoring area 301 is facing. In FIG. 3B, the orientation of the scoring area 301 may be parallel to directional arrow A. The process 400 may then proceed to block 430.

In block 430, the TSA 300 may identify and/or receive the path 310 of the projectile as it passed through the scoring area 301. In an exemplary embodiment, the path 310 may be determined by the sensor 306 and/or the scoring area 301. The process may then proceed to block 440.

In block 440, the TSA 300 may determine the angle 312 created between the path 310 of the projectile and the reference plane 314 by comparing the reference plane 314 to the path 310. In an exemplary embodiment, the angle 312 may be determined to be 120 degrees from the reference plane 314. The process 400 may then proceed to block 450.

In block 450, the process 400 may end.

In an exemplary embodiment, sensor 106 may include a non-contact acoustic sensor subsystem 232. An exemplary acoustic sensor subsystem 232 may include the models 2F2S or the 2F3S Enhanced TDCue Non Contract Hit Sensor manufactured by AAI Corporation of Hunt Valley, Md. USA.

Figure 5:
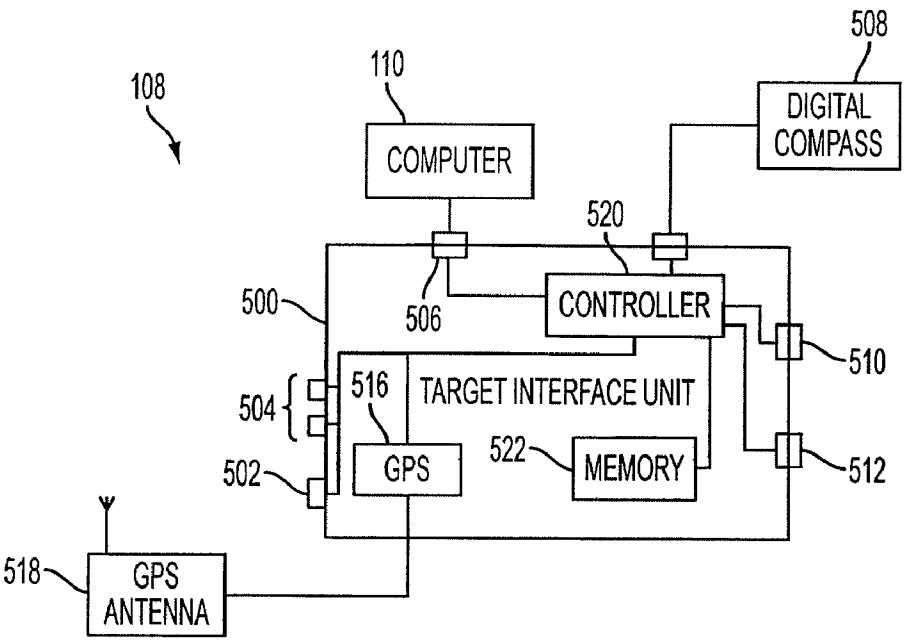
FIG. 5 depicts a block diagram for an exemplary target interface unit (TIU).

FIG. 5 depicts a block diagram 500 for an exemplary TIU 108 of an exemplary TSA 100. The TIU 108 may, for example, include, but is not limited to, a housing 500, one or more momentary switches 502, one or more status indicators 504, a computer input/output data port 506, a compass 508, an input/output data port 510, a power port 512, global positioning system (GPS) receiver 516, a GPS antenna 518, a controller 520, and/or memory 522. Controller 520 may include any of various well known microcontrollers.

In an exemplary embodiment, the housing 500 may be a housing or case made of any suitable materials, such as, for example, but not limited to, plastic, metal, rubber, and/or composites, in any suitable design. The other elements of the TSA 100 may be disposed on or within the housing 500. The housing 500 may be designed to withstand the stress of repeated use.

An exemplary embodiment of the TIU 108 may include a momentary switch 502. The momentary switch 502 may include one or more suitable electro-mechanical switch(s), button(s), and/or other input device(s) disposed on the outside of the housing 500. The momentary switch 502 may be positioned on the housing 500 such that the user of the apparatus may be able to access the momentary switch 502. The momentary switch 502 may be used, e.g., to input data to the controller 520, to allow a user to control the operation of the TIU 108, including, e.g., but not limited to, to allow a user to turn the TIU 108 on/off, and/or to indicate various conditions to the controller 520. For example, the user may press the momentary switch 502 to begin recording and/or may transmitting information related to a scoring event. As another example, holding the momentary switch 502 down for a specified period of time may signal the TIU 108 to enter a low-power consumption mode, and/or to shut down, etc.

An exemplary embodiment of the TIU 108 may include status indicators 504. Status indicators 504 may include one or more lights, light emitting diode (LED) indicators of one or more varying colors, a liquid crystal display (LCD) screen, or any other suitable visual display audio or output device. For example, as depicted in FIG. 5, the status indicators 504 may be a pair of LED indicators disposed on the outside of the housing 500, which may be disposed next to the momentary switch 502. The status indicators 504 may be used to convey information about the status of the TIU 108, and the various elements thereof, to a user of the TIU 108. For example, the status indicators 504 may indicate the condition of a battery (not shown) within the internal power source 212 and/or the external power source 216 such as, e.g., but not limited to, low battery, battery charging, and/or battery charged, attainment, or loss of the GPS signal by the GPS receiver 516, and/or data transfer activity through the data port 512, whether the TIU 108 is on or off, etc.

In an exemplary embodiment, the input/output data port 506 may be any, bus, port, suitable port or combination of ports for connecting the TIU 108 to a device, such as, for example, a computing device, to allow the device to access the elements of the apparatus. The data port 506 may be a wired port which may include a physical connection via a cable, wired, or wireless port implemented as wireless device. For example, the data port 506 may be, e.g., but not limited to, a wired universal serial bus (USB) port, a serial port, a parallel port, a bus interface, a universal serial bus (USB), a card bus interface, firewire, a personal computer memory card international association (PCMCIA) interface, an ISA, a PCI, etc., firewire port, eSATA port, or proprietary port, or a wireless USB device, Bluetooth device, or 802.11x standard wi-fi device. The data port 506 may allow a connected device access to the status indicators 504, the compass 508, the input/output data port 510, the power port 512, the global positioning system (GPS) receiver 516, the GPS antenna 518, the controller 520, and/or the memory 522 to, for example, allow for the test, repair, and/or calibration of the components of the TIU 108. A connected device, such as, for example, but not limited to, computer 110, may, e.g., use the data port 506 to read stored data from the memory 522, and/or write program code for use by the controller 520 to the memory 522, or other storage (not shown). If the data port 506 is a wired port, the data port 506 may be disposed on the outside or within the housing 500, as depicted in FIG. 5. If the data port 506 is a wireless port, the wireless device used to implement the data port 506 may be disposed within or outside the housing, on or connected to, or coupled to a control board.

In an exemplary embodiment, the compass 508 may be any device for determining a reference direction (such as, but not limited to, true north) relative to the magnetic poles of the earth. For example, the compass 508 may be a digital compass or a magnetic needle compass which has been compensated to identify the reference direction. The compass 508 may also be combined with the GPS receiver 516.

In an exemplary embodiment, the reference direction may be determined by a user survey. The user may then store the reference direction in memory 228, memory 522, and/or computer 110 for later reference.

In an exemplary embodiment, the input/output data port 510 may be any suitable port or combination of ports for connecting the apparatus to a device, such as, for example, a lifter 104 via input/output data port 210, to allow the device to access the elements of the TIU 108 and to allow the TIU 108 to access elements of the device. The data port 510 may be a wired port requiring a physical connection via, e.g., but not limited to, a cable, or wireless port implemented as wireless device. For example, the data port 510 may be a wired USB port, firewire port, eSATA port, or proprietary port, and/or a wireless USB device, Bluetooth device, or 802.11x standard wi-fi device. The data port 510 may, e.g., allow a connected or coupled device access to the status indicators 504, the compass 508, the input/output data port 510, the power port 512, the Global Positioning System (GPS) receiver 516, the GPS antenna 518, the controller 520, and/or the memory 522 to, for example, allow for the test, repair, and/or calibration of the components of the coupled apparatus. A connected or coupled device may use the data port 506 to read stored data from the memory 522, and to write program code for use by the controller 520 to the memory 522. If the data port 506 is a wired port, the data port 506 may be disposed on the outside of, or within the housing 500, as illustrated in FIG. 5. If the data port 506 is a wireless port, the wireless device used to implement the data port 506 may be disposed within the housing, on or connected to a control board. In addition, the data port 510, when coupled to input/output port 210 of the lifter 104, may also allow the TIU 108 access to the target 102 via target port 202, the sensor 106 via data input/output port 224, and/or power from the power supply 216 via the output power supply port 208.

In an exemplary embodiment of the TIU 108, the data input/output port 510 may be coupled to and/or send/receive data from the data input/output port 224 of the sensor 106 and/or the data input/output port 210 of the lifter 104.

In an exemplary embodiment of the TIU 108, the power port 512 may be coupled to and receive power from the output power supply port 208 of the lifter 104. In an exemplary embodiment, the one or more input/output power supply ports 208, 226, 512 may be combined with one or more of the data input/output ports 210, 224, 510 to form one or more combined ports.

In an exemplary embodiment, the GPS receiver 516 may be any suitable device for receiving and interpreting GPS signals to determine the location of the GPS receiver at any particular time. The GPS receiver 516 may be disposed within the housing 500, on a control board or otherwise connected thereto, or attached to the outside of the housing 500. When the controller 520 determines that a scoring event has occurred, the controller 520 may request time and/or location data from the GPS receiver 516, according to an exemplary embodiment. In an exemplary embodiment, the GPS receiver 516 may be able to determine a reference direction.

In an exemplary embodiment, the GPS receiver 516 may be positioned in close proximity to the target 102 in order to allow for a precise determination of the location of the target 102. Additionally, the GPS receiver 516 may be sensitive enough to determine location precisely and may be accurate enough to allow for the determination of the positions of two GPS receivers, which may be in close proximity to one another, to be distinguishable.

In an exemplary embodiment, if the GPS receiver 516 loses the GPS signal, and is therefore unable to determine the location of the target 102 on the basis of the GPS signal, the GPS receiver 516 may be able to determine the location of the target 102 through, e.g., interpolation, extrapolation, etc. The controller 520 may assist the GPS receiver 516 with calculations for performing the interpolation or extrapolation, if necessary. Interpolation may be based on previously determined location determination.

In an exemplary embodiment, the positional accuracy of the GPS receiver 516 may be increased by survey with a differential GPS and/or averaging two or more discrete location determinations over a period of time to arrive at an averaged target 102 location. The controller 520 may work in conjunction with the GPS receiver 516 to conduct the survey and/or calculate the averaged location. The precise target 102 location may be stored in memory 522.

In an exemplary embodiment, if the GPS receiver 516 loses the GPS signal, and is therefore unable to determine the location of the target 102 on the basis of the GPS signal, the GPS receiver 516 may be able to determine the location of the target 102 through interpolation. The controller 520 may assist the GPS receiver 516 with the calculation necessary to perform the interpolation, if necessary. Interpolation may be based on previously determined location determination.

In an exemplary embodiment, the GPS receiver 516 may be used to set an internal clock (not shown) of TIU 108. The controller 520 may retrieve time information from a clock when a scoring event occurs.

The GPS antenna 518 may be any antenna suitable for use with the GPS receiver 516. The GPS antenna 518 may be disposed on the outside or the inside of the housing 500. The GPS antenna 518 may pick up GPS signals and relay them to the GPS receiver 516.

Controller 520 may be any suitable microcontroller, processor, or microprocessor, digital signal processor, etc. capable of processing the data received from the scoring area 101, the sensor 106, the lifter 104, the controller 220, the digital compass 508, the computer 110, and the GPS receiver 516. Data from the scoring area 101, the sensor 106, the lifter 104, the controller 220, the digital compass 508, the computer 110, and/or the GPS receiver 105 may be sent to the controller 520, which may use the data to determine whether a scoring event has occurred. If a scoring event has occurred, the controller 520 may determine information about the scoring event in cooperation with scoring area 101, the sensor 106, the lifter 104, the controller 220, the digital compass 508, the computer 110, and/or the GPS receiver 105. The controller 520 may then store information about the scoring event in memory 228 and/or memory 522 and/or may transmit the information to computer 110. The controller 104 may also receive input from the momentary switch 502, control the status indicators 504, and, if necessary, facilitate the transfer of data from the memory 522 through input/output data port 510. The controller may be disposed within housing 500.

Memory 522 may include any computer readable medium, and/or storage device suitable for usage inside the housing 500. For example, the memory 522 may include, random access memory (RAM), read only memory (ROM), volatile or nonvolatile memory, a write once read or any (WORM) device, removable or non-removable flash memory, a magnetic drive, an optical drive, and/or a magnetic-optical drive capable of fitting within the housing 500, etc. The controller 520 may read from and write to the memory 522. Program code used by the controller 520, for example, program code for analyzing data from the sensor 106 and the lifter 104 that the controller 520 may use in determining if a scoring event has occurred, may be pre-written to the memory 522. In addition, data from the GPS receiver 516 may be written to the memory 522 by the controller 520 on the occurrence of certain events, such as, for example, a scoring event as determined by the controller 520. The memory 522 may be directly accessible by any suitable device connected to, or coupled to, the data port 506, or the controller 520 may be used as an intermediary by such a device. The memory 522 may be disposed within the housing 500, and may be directly disposed on a control board (not shown), or may be disposed elsewhere within the housing 500 and connected to, or coupled to the control board. The memory 522 may be fixed and/or removable. For example, if the memory 522 is, e.g., but not limited to, a Secure Digital flash memory card, the memory 522 may be inserted into the housing 500 through a slot in the housing 500, and may be removable.

In an exemplary embodiment, TIU 108 may, for example, receive and/or detect information relating to a scoring event from the scoring area 101, lifter 104, and/or sensor 106, process the information relating to a scoring event, store information relating to a scoring event and/or may transmit the information to computer 110. For example, the TIU 108 may determine the time of each scoring event, the location of the target 102, the orientation of the target 102, the trajectory of a projectile, which caused a scoring event, with respect to the reference direction, and/or whether the target 102 was in an exposed or non-exposed position at the time of scoring. The TIU 108 may make these determinations by receiving info from the lifter 104, the sensor 106, and/or scoring area 101. The TIU 108 may, e.g., store the information relating to a target 102, locally and/or may transmit the information relating to a scoring event to another computing device (such as, but not limited to, computer 110).

Figure 6:
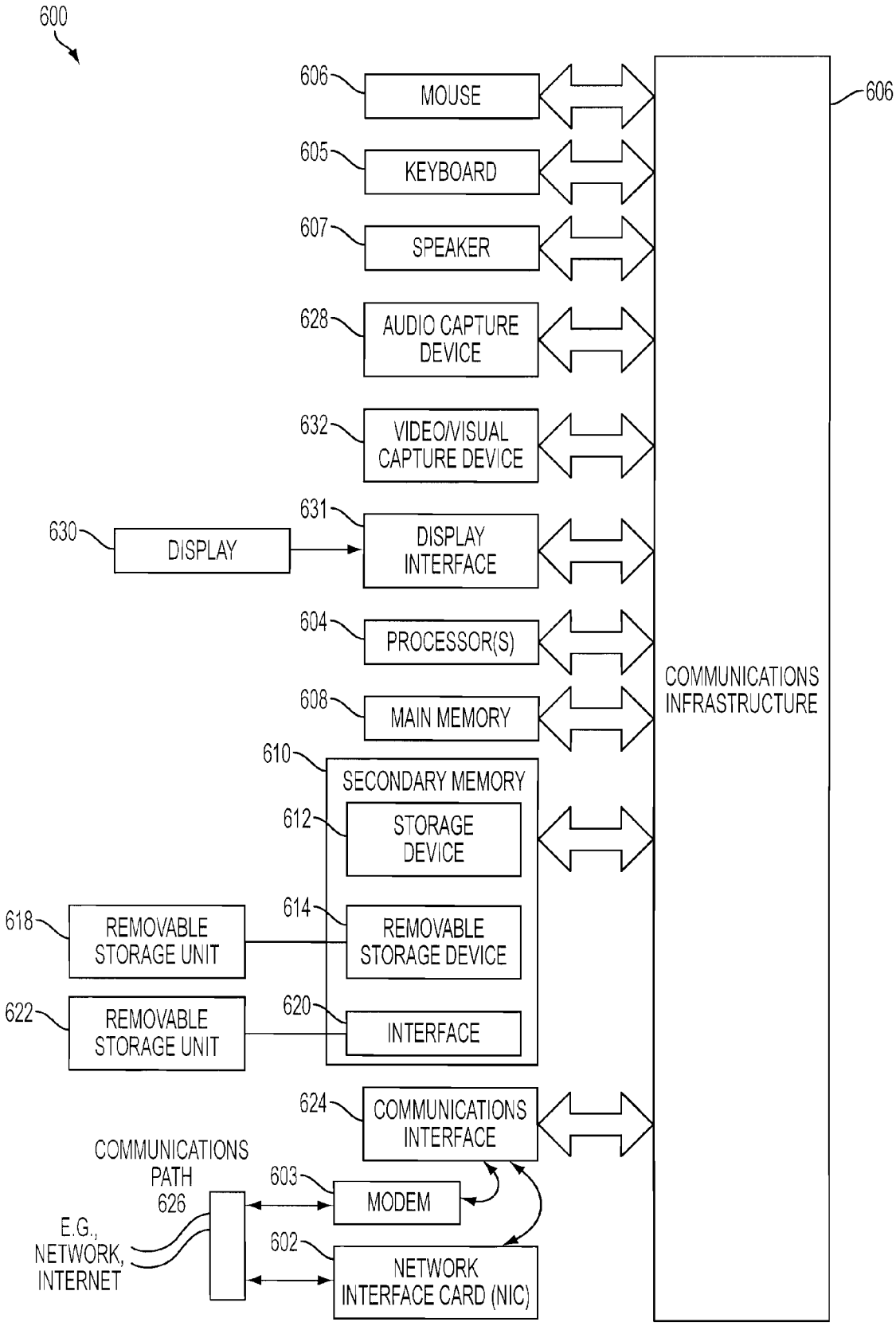
FIG. 6 depicts diagram 600 illustrating an exemplary computer system.

FIG. 6 depicts diagram illustrating an exemplary computer system 600 such as may be used in, or in combination with devices 104, 106, 108, 110, 220, 520, etc. and that may be used in implementing an exemplary embodiment of the present invention. Specifically, FIG. 6 depicts an exemplary embodiment of a computer system 600 that may be used in computing devices such as, e.g., but not limited to, a client and/or a server, etc., according to an exemplary embodiment of the present invention. The present invention (or any part(s) or function(s) thereof) may be implemented using hardware, software, firmware, and/or a combination thereof and may be implemented in one or more computer systems 600 or other processing systems. In fact, in one exemplary embodiment, the invention may be directed toward one or more computer systems capable of carrying out the functionality described herein. An example of a computer system 600 is shown in FIG. 6, depicting an exemplary embodiment of a block diagram of an exemplary computer system 600 useful for implementing the present invention. Specifically, FIG. 6 illustrates an example computer 600, which in an exemplary embodiment may be, e.g., but not limited to, a personal computer (PC) system running an operating system such as, e.g., (but not limited to) MICROSOFT® WINDOWS® NT/98/2000/XP/CE/ME/VISTA/etc. available from MICROSOFT® Corporation of Redmond, Wash., U.S.A. However, the invention may not be limited to these platforms. Instead, the invention may be implemented on any appropriate computer system running any appropriate operating system such as, e.g., but not limited to, an Apple computer executing MAC OS. In one exemplary embodiment, the present invention may be implemented on a computer system operating as discussed herein. An exemplary computer system, computer 600 is shown in FIG. 6. Other exemplary computer systems may include additional components, such as, e.g., but not limited to, a computing device, a communications device, mobile phone, a telephony device, an iPhone (available from Apple of Cupertine, Calif. USA), a 3G wireless device, a wireless device, a telephone, a personal digital assistant (PDA), a personal computer (PC), a handheld device, a portable device, an interactive television device (iTV), a digital video recorder (DVD), client workstations, thin clients, thick clients, fat clients, proxy servers, network communication servers, remote access devices, client computers, server computers, peer-to-peer devices, routers, gateways, web servers, data, media, audio, video, telephony or streaming technology servers, game consoles, content delivery systems, etc., may also be implemented using a computer such as that shown in FIG. 6. In an exemplary embodiment, services may be provided on demand using, e.g., but not limited to, an interactive television device (iTV), a video on demand system (VOD), via a digital video recorder (DVR), and/or other on demand viewing system.

The computer system 600 may include one or more processors, such as, e.g., but not limited to, processor(s) 604. The processor(s) 604 may be coupled to and/or connected to a communication infrastructure 606 (e.g., but not limited to, a communications bus, cross-over bar, or network, etc.). Various exemplary embodiments may be described in terms of this exemplary computer system 600. After reading this description, it may become apparent to a person skilled in the relevant art(s) how to implement the invention using other computer systems and/or architectures.

Computer system 600 may include a display interface 631 that may forward, e.g., but not limited to, graphics, text, and other data, etc., from the communication infrastructure 606 (or from a frame buffer, etc., not shown) for display on the display unit 630.

The computer system 600 may also include, e.g., but may not be limited to, a main memory 608, random access memory (RAM), and a secondary memory 610, etc. The secondary memory 610 may include a computer readable medium such as, for example, (but not limited to) a hard disk drive 612 and/or a removable storage drive 614, representing a floppy diskette drive, a magnetic tape drive, an optical disk drive, magneto-optical, a compact disk drive CD-ROM, etc. The removable storage drive 614 may, e.g., but not limited to, read from and/or write to a removable storage unit 618 in a well known manner. Removable storage unit 618, also called a program storage device or a computer program product, may represent, e.g., but not limited to, a floppy disk, magnetic tape, optical disk, compact disk, etc. which may be read from and written to by removable storage drive 614. As may be appreciated, the removable storage unit 618 may include a computer usable storage medium having stored therein computer software and/or data. In some embodiments, a "machine-accessible medium" may refer to any storage device used for storing data accessible by a computer. Examples of a machine-accessible medium may include, e.g., but not limited to: a magnetic hard disk; a floppy disk; an optical disk, like a compact disk read-only memory (CD-ROM), flash memory, non-volatile memory, or a digital versatile disk (DVD); digital video recorder disk (DVR); a magnetic tape; and a memory chip, etc.

In alternative exemplary embodiments, secondary memory 610 may include other similar devices for allowing computer programs or other instructions to be loaded into computer system 600. Such devices may include, for example, a removable storage unit 622 and an interface 620. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units 622 and interfaces 620, which may allow software and data to be transferred from the removable storage unit 622 to computer system 600.

Computer 600 may also include an input device such as, e.g., (but not limited to) a mouse 606 or other pointing device such as a digitizer, an audio capture device 628 (such as, e.g., but not limited to, a microphone), an image video/visual capture device 632 (such as, e.g., but not limited to, a camera), and a keyboard 605 and/or other data entry device (not shown), etc.

Computer 600 may also include output devices, such as, e.g., (but not limited to) display 630, display interface 631, and/or a speaker 607, etc. Other output devices may also be used, including, e.g., but not limited to, a printer, etc. Computer 600 may include input/output (I/O) devices such as, e.g., (but not limited to) communications interface 624 and communications path 626, etc. These devices may include, e.g., but not limited to, a network interface card 602, and modem(s) 603. Communications interface 624 may allow software and data to be transferred between computer system 600 and external devices.

In this document, the terms "computer program medium" and "computer readable medium" may be used to generally refer to media such as, e.g., but not limited to removable storage drive 614, a hard disk installed in hard disk drive 612, a storage area network (SAN), database, etc. These computer program products may provide software to computer system 600. The invention may be directed to such computer program products. In some cases, a computer program product may include software which may be distributed via a communication system and then may be stored on a storage device.

Figure 7:
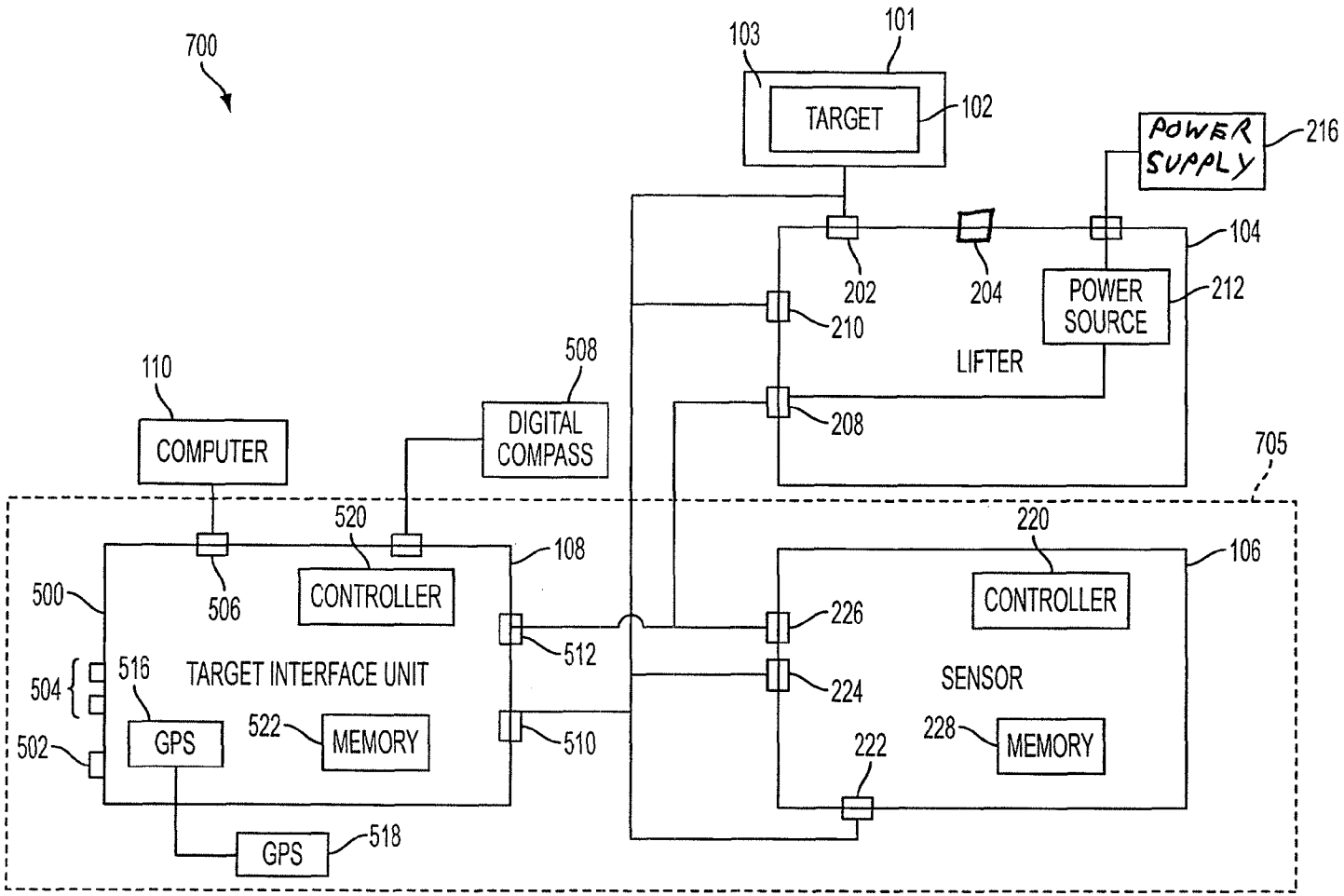
FIG. 7 depicts a block diagram for an exemplary TSA.

FIG. 7 depicts an exemplary TSA 700 comprising the scoring area 101, lifter 104, sensor 106, and/or TIU 108, where sensor 106 and TIU 108 are assembled in an exemplary housing 705, according to one exemplary embodiment.

Figure 8:
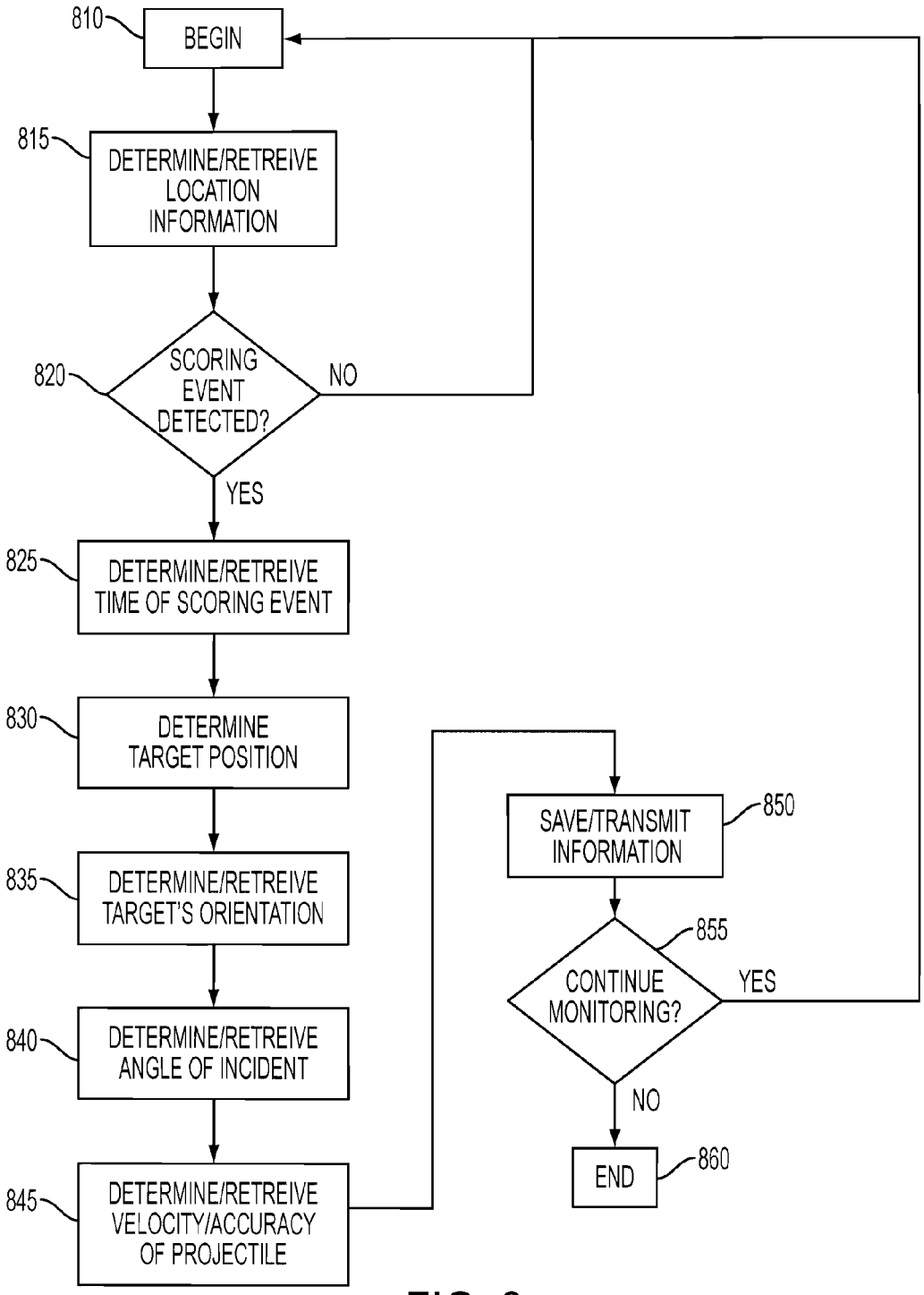
FIG. 8 depicts an exemplary flowchart for an exemplary operation of an exemplary TSA.

FIG. 8 depicts an exemplary flowchart for the operation of an exemplary TSA 100 and is described with reference to FIGS. 1, 2, 3A, 3B and 7. The flow diagram may begin with 810.

In block 810, the TIU 108 may begin sending/receiving data to/from the target 102, lifter 104 and/or the sensor 106. The process 800 may then proceed immediately to block 815.

In block 815, the TSA 100 may determine or retrieve, or receive the location of the target 102. The TSA 100 may determine the location of the target 102 via the lifter 104, the sensor 106, the TIU 108, and/or a user survey. Once determined, the location information may be stored in memory 522 of TIU 108 and/or may be transmitted to computer 110.

In an exemplary embodiment, the controller 520 may receive the target 102 location from, and/or determine the location of the target 102 in cooperation with, the GPS receiver 516. Once received and/or determined, the controller 520 may store the location information in memory 522 and/or may transmit the information to computer 110 in real-time, or on a delay. In an exemplary embodiment, the controller 520 may average target 102 location information and may determine an averaged target 102 location for a stationary target 102 over a period of time. Once the location is determined in 815, the process 800 may then continue to block 820.

In block 820, the TSA 100 may determine if a scoring event has occurred. The TSA 100 may determine if a scoring event has occurred via the lifter 104, the sensor 106, and/or the TIU 108. Once determined, the scoring event may be stored in memory 522 and/or may be transmitted to computer 110 in real-time and/or on a delay. If a scoring event has occurred, the process may continue to block 825.

In an exemplary embodiment, the sensor 106 may receive and/or determine the occurrence of a scoring event via the lifter 104 and relay the scoring event to the controller 520 in, e.g., real-time. Once received and/or determined, the controller 520 may store the scoring event in memory 522 and/or may transmit the occurrence of a scoring event to computer 110 in real-time, or on a delay.

If a scoring event has not occurred, the flow may proceed back to block 810 (FIG shows 810).

In block 825, the TSA 100 may determine the time at which the scoring event occurred. The TSA 100 may determine the time at which the scoring event occurred via the lifter 104, the sensor 106, and/or the TIU 108. Once determined, time at which the scoring event occurred may be stored in memory 522 and/or may transmitted the time of the scoring event to computer 110 in real-time, or on a delay. The process may then continue to block 830.

In an exemplary embodiment, the controller 520 may receive and/or determine the time at which the scoring event occurred from in cooperation with the GPS receiver 516. Once received and/or determined, the controller 520 may store the time at which the scoring event occurred in memory 522 and/or may transmit the information to computer 110 in real-time or on a delay.

In an exemplary embodiment, the TIU 108 may determine the time via an internal, or other, clock. The internal clock may be synchronized with the GPS receiver 516 at regular or irregular intervals to ensure accuracy.

In block 830, the TSA 100 may determine the position of the target 102 when the scoring event occurred. The TSA 100 may determine whether the target 102 was in an exposed or non-exposed position via target 102, the lifter 104, the sensor 106, and/or the TIU 108. Once determined, the position of the target 102 may be stored in memory 522 and/or may be transmitted to computer 110 in real-time or on a delay. The process may then continue to block 835.

In an exemplary embodiment, the sensor 106 may receive and/or determine the position of the target 102 via the lifter 104 and may relay the target 102 position to the controller 520 in real-time, or otherwise. Once received and/or determined, the controller 520 may store the occurrence of a scoring event in memory 522 and/or may transmit information to computer 110 in real-time, or on a delay.

In block 835, the TSA 100 may determine the orientation of the target 102 with respect to a reference direction (for example, true north). The TSA 100 may determine the orientation of the target 102 with respect to the reference direction via the lifter 104, the sensor 106, and/or the TIU 108. Once determined, the orientation of the target 102 with respect to the reference direction may be stored in memory 522 and/or may be transmitted to computer 110 in real-time, or on a delay.

In an exemplary embodiment, the orientation of the target 102 with respect to the reference direction may be determined by comparing the reference direction to the orientation of the target 102. In an exemplary embodiment, the controller 520 may receive and/or determine the orientation of the target 102 in cooperation with the target 102, the lifter 104, the sensor 106, and/or the GPS receiver 516. Once received and/or determined, the controller 520 may store the orientation of target 102 in memory 522 and/or may transmit the information to computer 110 in real-time or on a delay.

In an exemplary embodiment, the reference direction of true north may be determined by the controller 520, the compass 508 and/or the GPS receiver 516. The compass 508 and/or the GPS receiver 516 may be positioned on, or in close proximity to, the target 102 in order to facilitate such a determination. Once determined, the controller 520 may store the direction of true north in memory 522 and/or transmit the information to computer 110 in real-time or on a delay.

In an exemplary embodiment, the orientation of target 102 may also be determined by inputting the results of a survey to controller 520 of TIU 108 and/or the processor 220 of sensor 106. A survey may refer to a measurement of the orientation of a target 102 taken by a user.

In block 840, the TSA 100 may determine the angle between the trajectory of the projectile which caused the scoring event, as is passed through the scoring area 101, and a reference direction. The angle may be determined and/or received by the lifter 104, the sensor 106, and/or the TIU 108. Once determined, the angle may be stored in memory 522 and/or transmitted to computer 110 in real-time or on a delay.

In an exemplary embodiment, the angle between the trajectory of the projectile which caused the scoring event, as is passed through the scoring area 101, with respect to a reference direction may be determined by comparing the a trajectory of the projectile, with respect to the orientation of the scoring area 101, to the reference direction. In an exemplary embodiment, the controller 520 may receive and/or determine the trajectory of the projectile, with respect to the orientation of the scoring area 101, in addition to the reference direction in cooperation with the target 102, the lifter 104, the sensor 106, and/or the GPS receiver 516. Once received and/or determined, the controller 520 may store the angle between the trajectory of the projectile which caused the scoring event, as is passed through the scoring area 101, with respect to a reference direction in memory 522 and/or may transmit the information to computer 110 in real-time or on a delay.

In an exemplary embodiment, the angle between the trajectory of the projectile which caused the scoring event, as is passed through the scoring area 101, with respect to a reference direction may be determined by the controller 520, the compass 508 and/or the GPS receiver 516. The compass 508 and/or the GPS receiver 516 may be positioned on, or in close proximity to, the target 102 in order to facilitate such a determination. Once received determined, the controller 520 may store the angle between the trajectory of the projectile which caused the scoring event, as is passed through the scoring area 101, with respect to a reference direction in memory 522 and/or may transmit the information to computer 110 in real-time or on a delay.

In block 845, TSA 100 may determine the velocity and/or accuracy of the projectile which caused the scoring event may be determined. Once determined, velocity and/or accuracy of the projectile which caused the scoring event may be stored in memory 522 and/or may be transmitted to computer 110 in real-time or on a delay.

In an exemplary embodiment, the velocity and/or accuracy may be determined by the lifter 104, the sensor 106, and/or the TIU 108. Once determined, velocity and/or accuracy of the projectile which caused the scoring event may be stored in memory 522 and/or may be transmitted to computer 110 in real-time or on a delay.

In block 850, the TSA 100 may save the information determined in blocks 815-845 to memory 522 and/or may transmit the information to computer 110. The process may then continue onto block 855.

In block 855, the TSA 100 may determine whether to continue sending/receiving data to/from the target 102, lifter 104 and/or the sensor 106. If the TSA 100 continues sending/receiving data to/from the target 102, lifter 104 and/or the sensor 106, the process may proceed to block 810. If the TSA 100 discontinues sending/receiving data to/from the target 102, lifter 104 and/or the sensor 106, the process may proceed to block 860.

In an exemplary embodiment, the TSA 100 may wait a short period of time before proceeding back to block 810. Waiting a short period of time may prevent the TSA 100 from erroneously detecting scoring events. Erroneous detections of scoring events may be caused by, for example, reflections of acoustical waves and/or mechanical vibrations.

In block 860, the process may end.

Figure 9A:
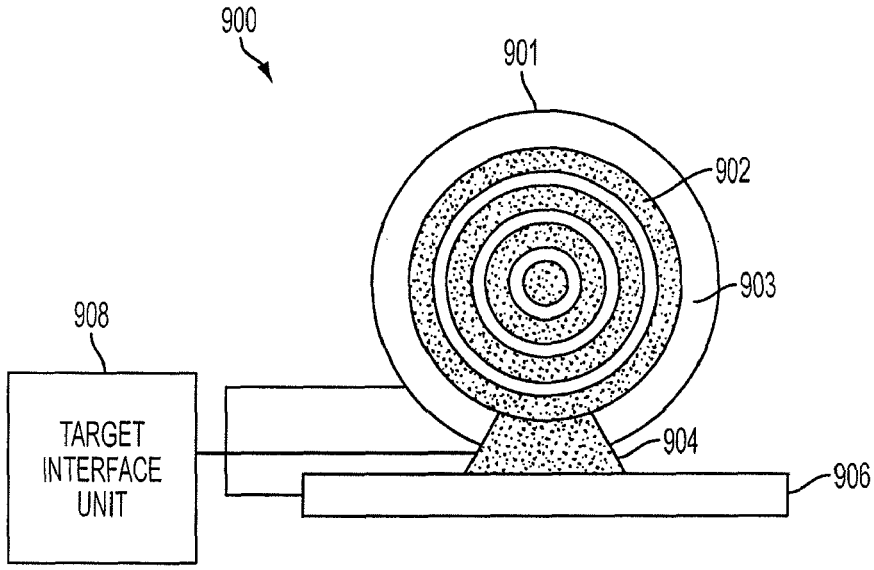
FIGS. 9A and 9B depict an exemplary front view and top view of an exemplary target scoring apparatus, respectively.
Figure 9B:
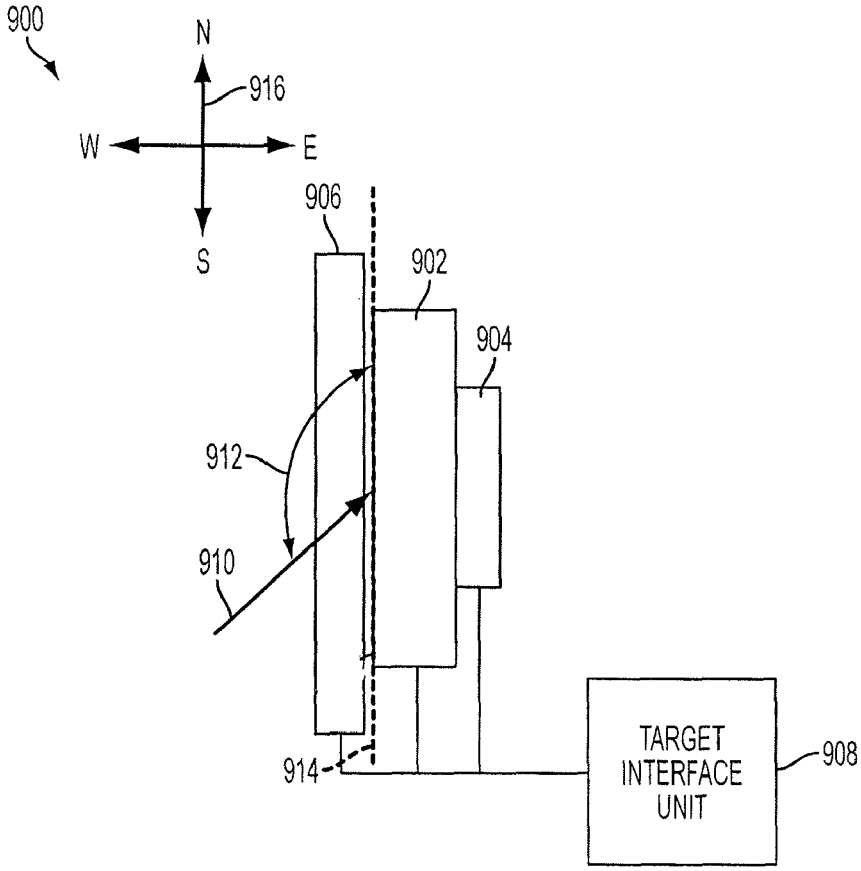

FIGS. 9A and 9B depict an exemplary front view and top view of an exemplary target scoring apparatus 900, respectively.

FIG. 9A depicts an exemplary front view of an exemplary scoring area 901, a target 902, a suppression zone 903 attached, connected, and/or coupled, directly or indirectly, to an exemplary lifter 904, a sensor 906, and a TIU 908. In an exemplary embodiment, sensor 906 may be positioned in front of the scoring area 901.

FIG. 9B depicts the exemplary top view of an exemplary scoring area 901, lifter 904, and sensor 906, along with the path 910 of an exemplary projectile as it passes through scoring area 902, a reference plane 914, and a compass rose 916.

Figure 10:
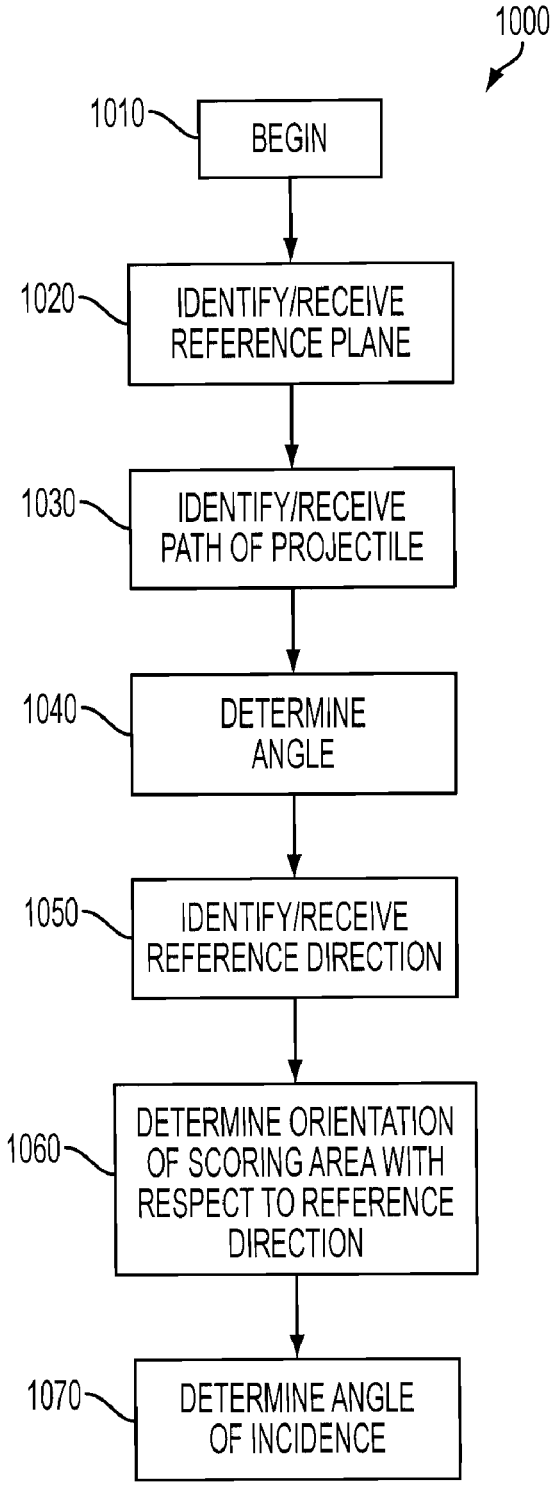
FIG. 10 depicts an exemplary flowchart for the operation of an exemplary TSA.

FIG. 10 depicts an exemplary flowchart 1000 for the operation of an exemplary TSA 900 to determine the angle between the trajectory of a projectile which caused a scoring event, as is passed through a scoring area 901, with respect to a reference direction.

The trajectory of the projectile may refer to the angle 912 created between the path 910 of the projectile and the reference plane 914 (e.g., the angle of incidence). Flowchart 1000 is described with references to FIGS. 9A and 9B. Flow diagram 1000 may begin with block 1010 and proceed directly to block 1020.

In block 1020, the TSA 900 may identify and/or receive the reference plane 914. In FIG. 9B, the reference plane 914 may be perpendicular to the orientation of the scoring area 901. The orientation of the scoring area 901 may refer to the direction the scoring area 901 is facing. In FIG. 9B, the orientation of the scoring area 901 may be facing West, as indicated by compass rose 916. The process 1000 may then proceed to block 1030.

In block 1030, the TSA 900 may identify and/or receive the path 910 of the projectile as it passed through the scoring area 901. In an exemplary embodiment, the path 910 may be determined by the sensor 906 and/or the scoring area 901. The process may then proceed to block 1040.

In block 1040, the TSA 900 may determine the angle 912 created between the path 910 of the projectile and the reference plane 914 by comparing the reference plane 914 to the path 910. In an exemplary embodiment, the angle 912 may be determined to be 120 degrees from the reference plane 914. The process 900 may then proceed to block 1050.

In block 1050, the TSA 900 may identify and/or receive the reference direction. In an exemplary embodiment, the reference direction may be true north. The process 1000 may then proceed to block 1060.

In block 1060, the TSA 900 may determine the orientation of the scoring area 901 with respect to the reference direction (i.e. true north). The orientation of the scoring area 901 may be determined by comparing the reference direction (i.e. true north) to the orientation of the target 902. True north, denoted by compass rose 916, may be determined the TSA 900 with the assistance of a controller (not shown), a GPS receiver (not shown), and/or a compass 508 (not shown). Once the direction of true north is determined, the orientation of the target 902 with respect to true north may be determined by the TSA 900 with the assistance of a controller (not shown), the target 902, the lifter 904 and/or the sensor 906. The controller (not shown) may then compare the two and determine the orientation of the target 902 and/or the scoring area 901 to true north (i.e., the direction the front surface of the target 902 faces with respect to true north). In FIG. 9B, the exemplary target 902 is oriented to the West, or 240 degrees from true north. The process 1000 may then proceed to block 1070.

In block 1070, the TSA 900 may determine the angle of incidence, (e.g. between the trajectory of the projectile which caused the scoring event, as is passed through the scoring area 901, with respect to the reference direction). The angle may be determined by comparing the orientation of the target 902 (which may have been previously computed as 240 degrees from true north) to the trajectory of the projectile. In an exemplary embodiment, the trajectory of the projectile when it passed through the scoring area 901 may be determined by the sensor 106 to be 135 degrees. Thus, the angle between the trajectory of the projectile which caused the scoring event, as is passed through the scoring area 901, with respect to a reference direction may be computed to be 225 degrees from true north. The process 1000 may then end.

While various exemplary embodiments have been described above, it should be understood that they have been presented by way of example only, and not limitation. Thus, the breadth and scope of the present invention should not be limited by any of the above-described exemplary embodiments, but should instead be defined only in accordance with the following claims and their equivalents.

What is claimed is:

1. An apparatus for registering a scoring event comprising:

a scoring area;

a sensor, positioned in proximity to said scoring area, adapted to detect the scoring event, the scoring event resulting from the presence of a projectile in said scoring area, and to determine a path of the projectile while in said scoring area;

a time tracking device adapted to keep track of time;

a location detection device adapted to identify a location of said scoring area;

a reference direction device adapted to identify a reference direction;

a memory; and a controller, coupled to said sensor, said time tracking device, said location detection device, said reference direction device, and said memory, said controller adapted to determine, based on said path of the projectile and said reference direction, an angle of incidence, with respect to said reference direction, of the projectile, said controller adapted to determine a time of the scoring event in cooperation with said time tracking device and said sensor, said controller adapted to determine a location of the scoring event in cooperation with said location detection device and said sensor, and said controller adapted to record, in said memory, said occurrence of the scoring event, said angle of incidence, said time of the scoring event, and said location of the scoring event.

2. The apparatus of claim 1, wherein:

said sensor is adapted to transmit the occurrence of the scoring event caused by the projectile and said path of the projectile to said controller;

said time tracking device transmits said time to said controller;

said location detection device transmits said location of said scoring area to said controller; and said reference direction device transmits said reference direction to said controller.

3. The apparatus of claim 1, further comprising:

a target disposed in said scoring area; and a lifter coupled to said target and adapted to move said target between a scoring and non-scoring position.

4. The apparatus of claim 1, wherein said time tracking device, said location detection device, and said reference direction device are disposed within a housing.

5. The apparatus of claim 1, wherein said time tracking device, said location detection device, and said reference direction device comprise a global positioning system (GPS) receiver.

6. The apparatus of claim 1, wherein said location detection device comprises a global positioning system (GPS) receiver and the time tracking device comprises an internal clock synchronized by said GPS receiver.

7. The apparatus of claim 1, further comprising:

a velocity sensing device adapted to record a velocity of the projectile.

8. The apparatus of claim 1, wherein the location of the scoring event is the location of said scoring area when the scoring event occurred.

9. A method for registering a scoring event comprising:

determining that the scoring event, caused by a projectile, has occurred in the vicinity of a target;

determining a position of said target when the scoring event occurred;

determining a time at which the scoring event occurred;

determining an orientation of the scoring area, with respect to a reference direction when the scoring event occurred;

determining an angle of incidence of the projectile when the scoring event occurred based on said orientation of said scoring area; and recording said time at which the scoring event occurred and said angle of incidence of the projectile in a memory.

10. The method of claim 9, further comprising determining a velocity of the projectile.

* * * * *